United States Patent [19]

Elsinger

[11] 4,308,989

[45] Jan. 5, 1982

[54] SIGNAL FLAG FOR NEWSPAPER CONTAINER

[76] Inventor: Richard R. Elsinger, Box 45, Woodland, Wis. 53099

[21] Appl. No.: 127,625

[22] Filed: Mar. 6, 1980

[51] Int. Cl.[3] ..... B65B 91/00

[52] U.S. Cl. ..... 232/34; 232/1 C

[58] Field of Search ..... 232/34, 35, 1 C

[56] References Cited

U.S. PATENT DOCUMENTS

| | | | |
|---|---|---|---|
| 1,712,827 | 5/1929 | Keeran | 232/34 |
| 2,496,962 | 2/1950 | Shaw | 232/34 |
| 2,553,164 | 5/1951 | Bishop | 232/34 |
| 2,927,726 | 3/1960 | Workman | 232/34 |
| 3,830,424 | 8/1974 | Pittman | 232/35 |
| 3,888,409 | 6/1975 | Bolduc | 232/35 X |
| 3,960,316 | 6/1976 | Echterling | 232/35 X |
| 3,960,317 | 6/1976 | Clement | 232/35 |
| 4,007,870 | 2/1977 | Hankis | 232/34 |
| 4,063,681 | 12/1977 | Tong | 232/34 |
| 4,205,778 | 6/1980 | File | 232/35 |

*Primary Examiner*—Roy D. Frazier
*Assistant Examiner*—Peter A. Aschenbrenner
*Attorney, Agent, or Firm*—Henry C. Fuller

[57] ABSTRACT

A signal device for a newspaper delivery box includes a hinged actuator located within the box and in the path of movement of an inserted newspaper, and includes a latch portion which projects through an opening in the side wall of the newspaper box to releasably engage a gravity biased, pivotally connected signal flag.

3 Claims, 4 Drawing Figures

SIGNAL FLAG FOR NEWSPAPER CONTAINER

BACKGROUND OF THE INVENTION

Various devices have been developed to provide a visual signal when a newspaper has been inserted in a delivery box. U.S. Pat. Nos. 4,007,870; 2,553,164; and 2,496,962 are illustrative of devices of this type. In addition, various signal devices have been developed for use with mailboxes. U.S. Pat. No. 3,960,317 is illustrative of patents in this category.

SUMMARY OF THE INVENTION

The invention provides a signal device for a newspaper delivery box which is relatively simple and has an actuator located within the interior of the newspaper delivery box with only a latch member extending through a side opening in the delivery box to release a gravity-biased signal flag to an erect position from a retracted position engaged with the latch. The pivot for the door and the spring for the door are located well within the interior of the receptacle which thus minimizes freezing of the pivot and spring. The elongated lever arm about which the weight acts on the signal flag pivot insures dependable swinging movement to the signal position, notwithstanding poor weather conditions.

Further objects, advantages and features of the invention will become apparent from the disclosure.

DESCRIPTION OF THE PREFERRED EMBODIMENT

Although the disclosure hereof is detailed and exact to enable those skilled in the art to practice the invention, the physical embodiments herein disclosed merely exemplify the invention which may be embodied in other specific structure. The scope of the invention is defined in the claims appended hereto.

Figure 1:
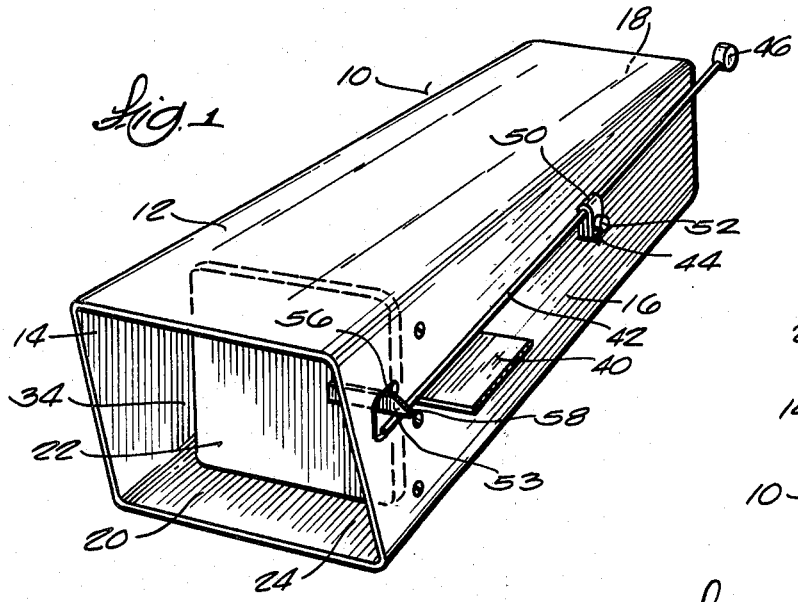
FIG. 1 is a perspective view of the newspaper delivery box with a signal flag attachment of the invention showing the signal flag in the retracted stored position.

In the drawings, a newspaper delivery box 10 is shown which has a top wall 12, side walls 14 and 16, an end wall 18 and an open mouth 20. In accordance with the invention, an actuator door 22 is located within the interior 24 of the receptacle and is provided with a hinged or pivotal connection 26 (FIG. 4) to the side wall 14. Means are provided to bias the door to the closed position shown in FIG. 1. As disclosed, the means comprises a coil spring 28 which has one end anchored at 30 on the inside surface of the side wall 14 and the other end anchored at 32 on the rear of the door 22. There is desirably enough clearance between the door edge 34 and the side wall 16 so that the hand will not get wedged in the box upon insertion past the door 22.

Figure 2:
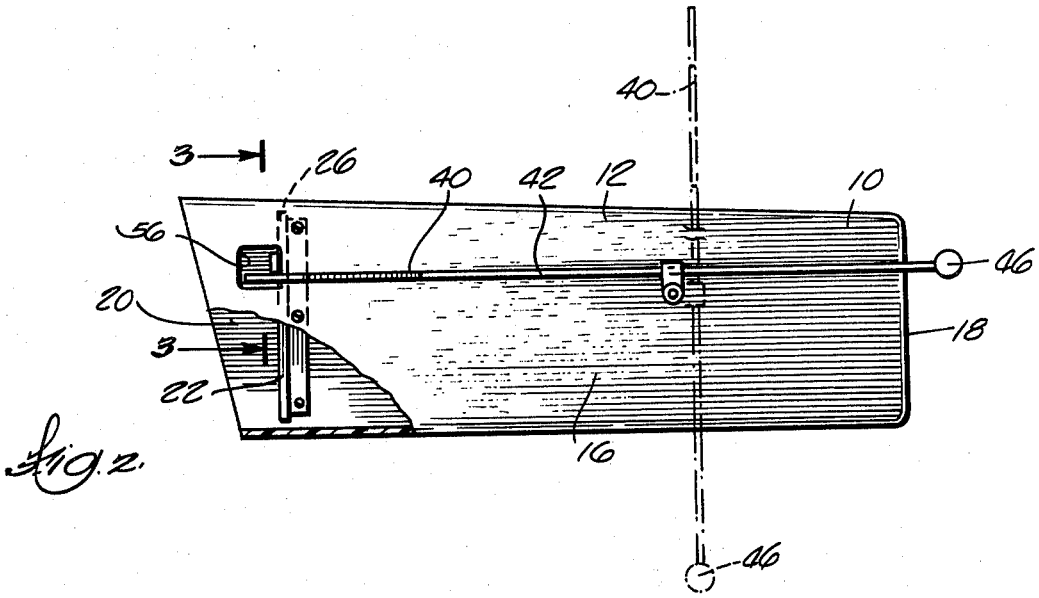
FIG. 2 is a side elevational view of the newspaper delivery box shown in FIG. 1, with the flag shown in full lines in the retracted position and in broken lines in the signal position.

The signal flag 40 is supported on a rod 42 which is pivotally connected at 44 to the side wall 14 of the box. A weight 46 is attached to the end of the rod remote from the flag to pivot the rod and flag to the erect position shown in FIG. 2 when the flag 40 is released, as presently described. The pivot for the rod comprises a U-shaped clamp 50 which is welded or otherwise fixed to the rod and a pivot pin 52 which extends through the legs of the clamp and is pinned on the inside to the side wall 14.

Figure 4:
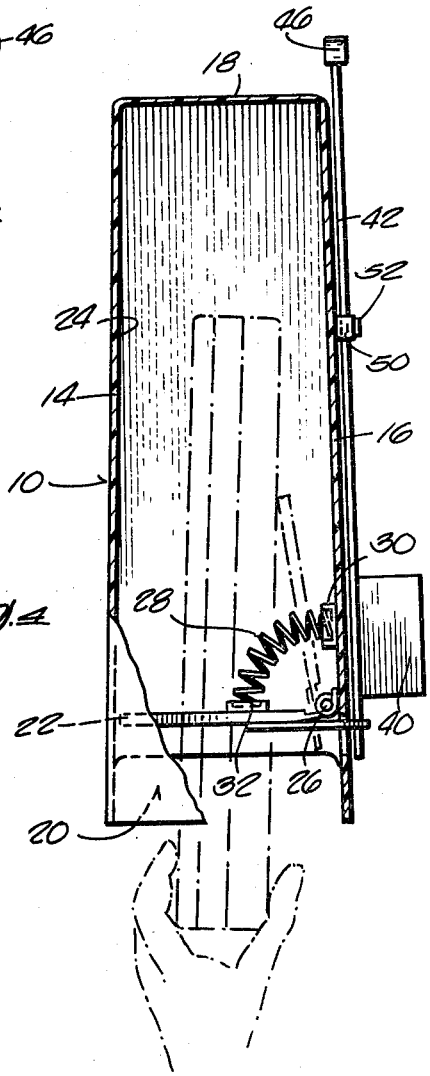
FIG. 4 is a plan view showing installation of a newspaper.
Figure 3:
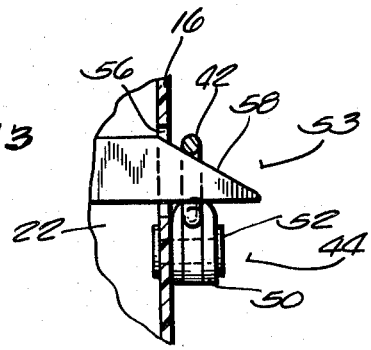
FIG. 3 is a view along lines 3—3 of FIG. 2.

In operation, the displacement of the door or actuator 22 by the insertion of a newspaper, as shown in FIG. 4 will cause the actuator catch 53, which is integral with the actuator door 22, to swing into the opening 56 in the side wall and release the signal rod 42 to cause the signal rod to pivot to the erect position under the influence of gravity. The catch 53 can be provided with a cam surface 58 to facilitate movement of the arm past the catch when resetting the signal device.

I claim:

1. In a newspaper delivery box having side walls, an end wall and an open end defining a receptacle for receiving a newspaper, the improvement comprising an actuator, means for pivotally mounting the actuator in the interior of said box and positioned relative to the entrance of the box to insure displacement of said actuator when a newspaper is inserted, an opening in a side wall of said receptacle, and catch means connected to said actuator and extending laterally outwardly of said receptacle through said opening and a signal member having a portion engageable with said catch means to be retained in a retracted position beneath said catch means, and means pivotally mounting said signal member to said side wall, said catch means including cam surface means engageable with said signal member portion, said cam surface means being operable to displace said portion laterally outwardly of said catch means to facilitate positioning said signal member portion beneath said catch means in a locking position, and means to bias said signal member to an erect position visible from some distance so that upon release from said catch said signal member will be released to move to the signal position.

2. The improvement of claim 1 wherein said means to bias the signal member to the erect position comprises a weight at one end of said member opposite the portion which contacts the catch so that gravity action on the weight causes the released signal member to assume a generally vertical position.

3. The improvement of claim 1 including spring means to bias the actuator to a position obstructing the entrance to said box, said spring means being yieldable upon insertion of a newspaper to cause movement of the catch to release the signal member.

* * * * *